US005975690A

United States Patent [19]

Grellmann et al.

[11] Patent Number: 5,975,690

[45] Date of Patent: Nov. 2, 1999

[54] SOLID INK STICK SUPPLY SYSTEM

[75] Inventors: H. Erwin Grellmann, Aloha; John B. Gilbert; Robert C. Tidrick, both of Portland; Perry E. Wingfield, Tigard, all of Oreg.

[73] Assignee: Tektronix, Inc., Wilsonville, Oreg.

[21] Appl. No.: 08/792,603

[22] Filed: Jan. 31, 1997

Related U.S. Application Data

[63] Continuation-in-part of application No. 08/708,766, Sep. 5, 1996.

[51] Int. Cl.[6] ..... B41J 2/175

[52] U.S. Cl. ..... 347/88; 347/99

[58] Field of Search ..... 347/88, 99

[56] References Cited

U.S. PATENT DOCUMENTS

| | | | |
|---|---|---|---|
| 4,609,924 | 9/1986 | DeYoung | 346/1.1 |
| 4,636,803 | 1/1987 | Mikalsen | 346/1.1 |
| 4,667,206 | 5/1987 | DeYoung | 346/1.1 |
| 4,682,185 | 7/1987 | Martner | 346/140 |
| 4,682,187 | 7/1987 | Martner | 346/140 |
| 4,739,339 | 4/1988 | DeYoung et al. | 346/1.1 |
| 4,870,430 | 9/1989 | Daggett et al. | 346/140 |
| 5,038,157 | 8/1991 | Howard | 346/140 |
| 5,172,135 | 12/1992 | Creagh et al. | 346/1.1 |
| 5,181,049 | 1/1993 | Mackay et al. | 316/140 |
| 5,223,860 | 6/1993 | Loofbourow et al. | 346/140 |
| 5,341,164 | 8/1994 | Miyazawa et al. | 347/88 |
| 5,861,903 | 1/1999 | Crawford et al. | 347/88 |

FOREIGN PATENT DOCUMENTS

| | | |
|---|---|---|
| 6425135 | 2/1989 | Japan . |
| 60-135260 | 7/1995 | Japan . |

*Primary Examiner*—John Barlow
*Assistant Examiner*—Christina Annick
*Attorney, Agent, or Firm*—Charles F. Moore

[57] ABSTRACT

A solid ink stick supply system and related method for delivering solid ink sticks to an ink jet print head reservoir is disclosed. The supply system includes a housing with a keyed plate that guides the ink sticks into the proper loading position in a supply channel. A pusher rod in the supply channel transfers an ink stick onto an endless belt for delivery to the print head reservoir. A push device on the endless belt engages and delivers the ink stick to the print head reservoir. A second ink stick is transferred from the supply channel to the endless belt and is retained on the belt by a stop device. A method for efficiently loading ink sticks into the supply system is also provided.

12 Claims, 11 Drawing Sheets

SOLID INK STICK SUPPLY SYSTEM

This Application is a continuation-in-part of Ser. No. 08/708,766, filed Sep. 5, 1996, the disclosure of which is incorporated into this document as if set forth fully herein.

FIELD OF THE INVENTION

This invention relates generally to supplying solid ink sticks to an ink jet printer and, more specifically, to a color ink stick supply system and related method for continuously supplying ink sticks to a phase change or solid ink color printer. The supply system stores multiple ink sticks in a housing and transfers the ink sticks to a conveyor means for delivery to a print head reservoir. The related method provides a simple and efficient loading procedure that assures proper orientation of the ink sticks in the housing.

BACKGROUND OF THE INVENTION

Ink jet printers typically utilize a variety of inks, including phase change or solid inks, which are sometimes referred to as hot melt inks. Phase change inks are solid at ambient temperatures and liquid at the elevated operating temperatures of an ink jet printing device. Phase change ink is conveniently stored, transported and introduced into an ink jet printer assembly in a solid form. Prior to printing, the ink is heated to a suitable liquid phase temperature. During printer operation, liquid phase ink is supplied to the print head at the proper temperature for ejection.

Color ink jet printers typically use at least one reservoir corresponding to each different color. Separate ink jets communicate with each reservoir for printing the various ink colors. An important consideration in the design of phase change ink jet printers is providing a substantially continuous supply of liquid ink at the ink jet print head from solid ink supply means.

Early solid ink jet printers used pellets of colored cyan, yellow, magenta and black ink that were loaded into shape coded openings. The openings fed the pellets generally vertically and downwardly by gravity into the heater assembly of the printer where they entered separate reservoirs corresponding to each color. In each reservoir the ink sticks were melted into a liquid state for jetting onto the receiving medium. Other prior art solid ink jet printers used a flexible web of hot melt ink that was incrementally unwound and advanced to a heater location, or vibratory delivery of particulate solid ink to the melt chamber.

Later more successful solid ink printers, such as the Tektronix Phaser® III, the Tektronix Phaser® 300, and the Jolt printer offered by Dataproducts Corporation, used differently shaped solid ink sticks that were either passively fed by gravity or spring loaded into a feed chute. Other ink stick loading systems have utilized a horizontal feed tray in which individual ink sticks are stored end-to-end. The ink sticks are advanced in the feed tray until they fall by gravity through an aperture into a print head reservoir.

While generally adequate for their intended purposes, the prior art solid ink supply systems have a relatively limited ink stick storage capacity and are typically mechanically complex. Additionally, phase change ink color printers are now being utilized to print on wide format (E-size) media of various types. These wide-format printers consume much larger quantities of ink per print as compared to the prior art solid ink printers for standard-sized media. Accordingly, this development has emphasized the need for a large capacity ink stick supply system that provides a substantially continuous ink flow with a minimum of operator refilling requirements and mechanical failures. To assure continuous and unrestricted delivery of ink sticks to the printer, and to reduce costly down time, it is desirable that the system include provisions to prevent the individual ink sticks from adhering to adjacent surfaces in the supply system or to one another. It is also desirable to provide a simple and efficient procedure for loading a large number of multi-colored ink sticks into the supply system. The loading procedure and the supply system should cooperate to assure that the correct ink color is provided to the appropriate print head reservoir.

SUMMARY OF THE INVENTION

It is an aspect of the present invention to provide an ink stick supply system for a solid ink printer that includes a large storage capacity for delivering a substantially continuous supply of ink sticks to a print head reservoir for printing.

It is another aspect of the present invention to provide an ink stick supply system that utilizes a mechanically simple ink stick delivery mechanism that operates effectively and reliably in a solid ink printing environment.

It is another aspect of the present invention to provide an ink stick supply system that avoids jamming by preventing ink sticks from adhering to adjacent surfaces or to one another.

It is yet another aspect of the present invention to provide an ink stick supply system that positively delivers individual ink sticks to the print head reservoir.

It is a feature of the present invention that the procedure for loading ink sticks into the supply system is efficient and assures that the ink sticks are properly oriented and delivered to the correct reservoir.

It is another feature of the present invention that the solid ink stick supply system positively transfers individual ink sticks to a conveyor means for delivery to the print head.

It is an advantage of the present invention that the solid ink stick supply system and loading procedure permit only the correctly colored ink stick to be fed into the appropriate supply channel for that color.

It is another advantage of the present invention that only properly oriented ink sticks are fed into the supply channel to reduce the possibility of jamming.

To achieve the foregoing and other aspects, features and advantages, and in accordance with the purposes of the present invention as described herein, an improved ink stick supply system and related method are provided that deliver a substantially continuous supply of solid ink sticks to a print head reservoir. The ink supply system reduces the possibility of jams and misfeeds by positively conveying individual ink sticks to the appropriate ink reservoir. The related procedure for loading ink sticks into the supply system is simple to execute and assures that the ink sticks are properly orientated for delivery to the appropriate ink reservoir.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive. And now for a brief description of the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
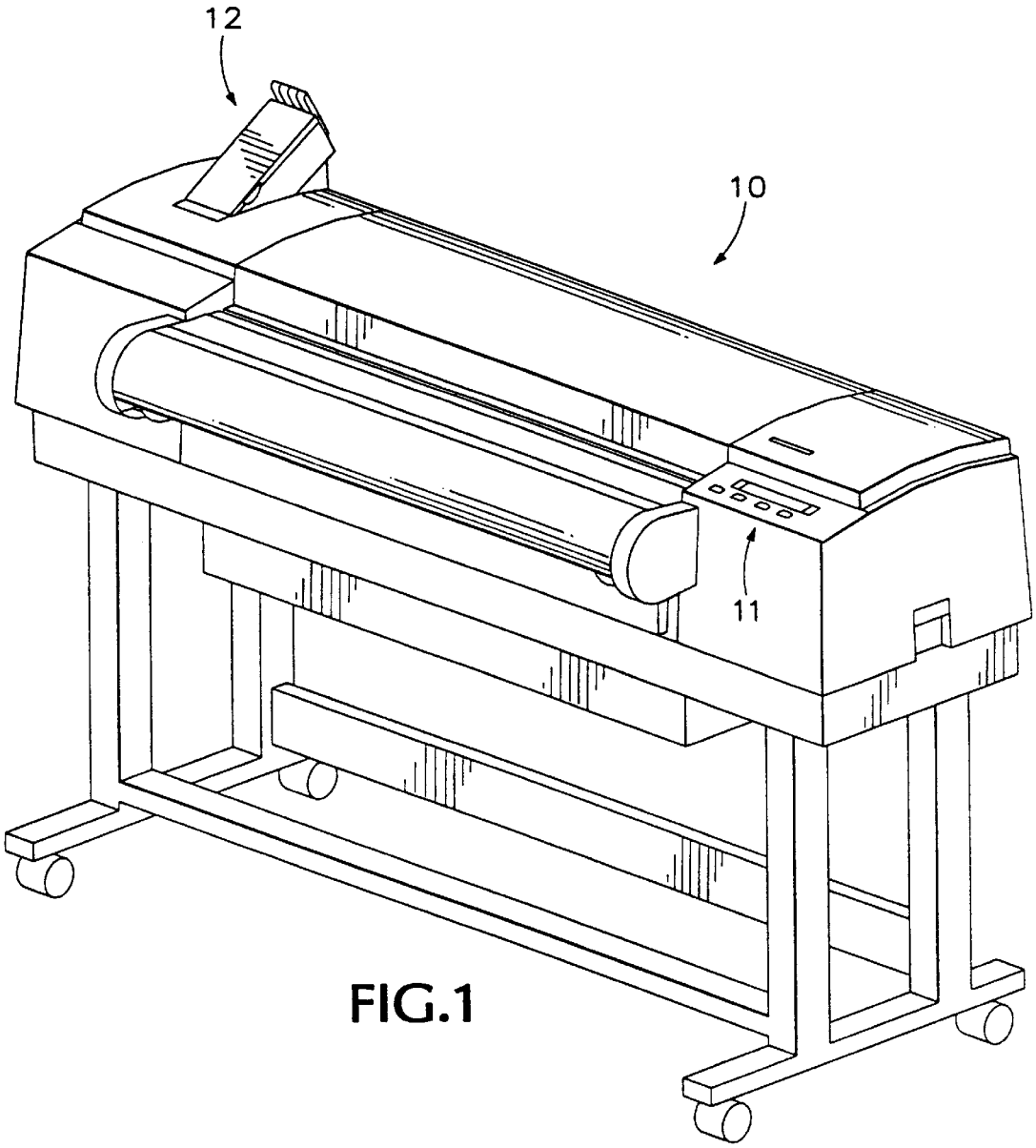
FIG. 1 is an overall perspective view showing a solid ink color printer that is particularly adapted for printing on wide format media and utilizes the solid ink supply system of the present invention.

Reference is now made to FIG. 1 of the drawings which shows an overall view of a wide format solid ink color printer 10 that incorporates the solid ink supply system of the present invention, generally represented by the reference numeral 12. The wide format color printer 10 includes an ink jet print head that utilizes a plurality of inks having different color characteristics. The ink jet print head includes a reservoir for each color where the solid ink sticks are melted to the liquid phase by heaters and the liquified ink is delivered to the print head to permit jetting in the heated liquid phase. An example of this type of print head is disclosed in U.S. Pat. No. 5,455,615 for a MULTIPLE-ORIFICE DROP-ON-DEMAND INK JET PRINT HEAD HAVING IMPROVED PURGING AND JETTING PERFORMANCE, assigned to the assignee of this application. The '615 patent is hereby specifically incorporated by reference in pertinent part. It should be noted that the ink supply system of the present invention is also suitable for use with other types of ink jet printers, other ink jet print heads and with inks having distinctive properties other than color.

Figure 2:
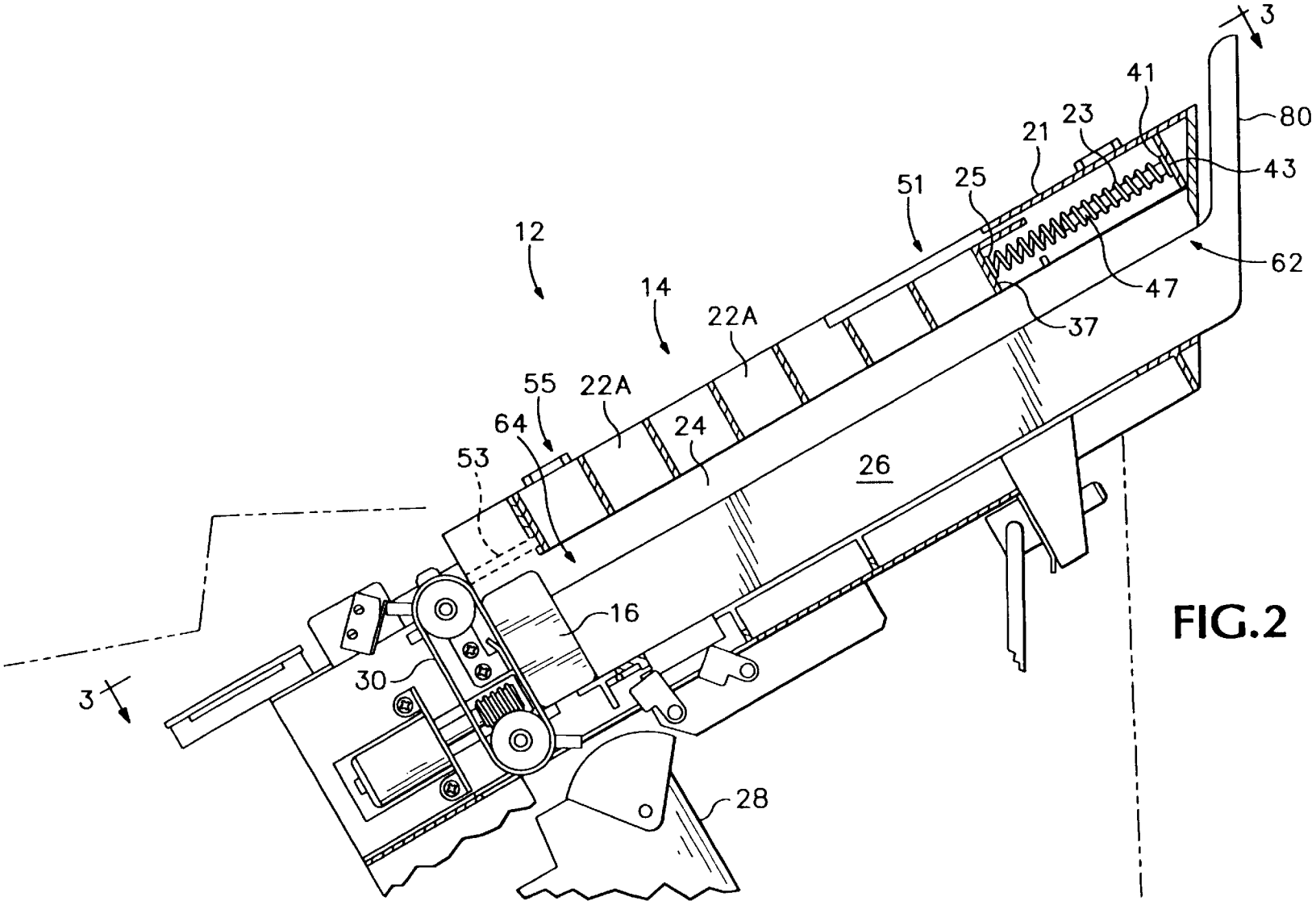
FIG. 2 is a side elevational view in partial cross section of the solid ink supply system showing a pusher rod fully extended into a supply channel and a single ink stick positioned on an endless belt.
Figure 3:
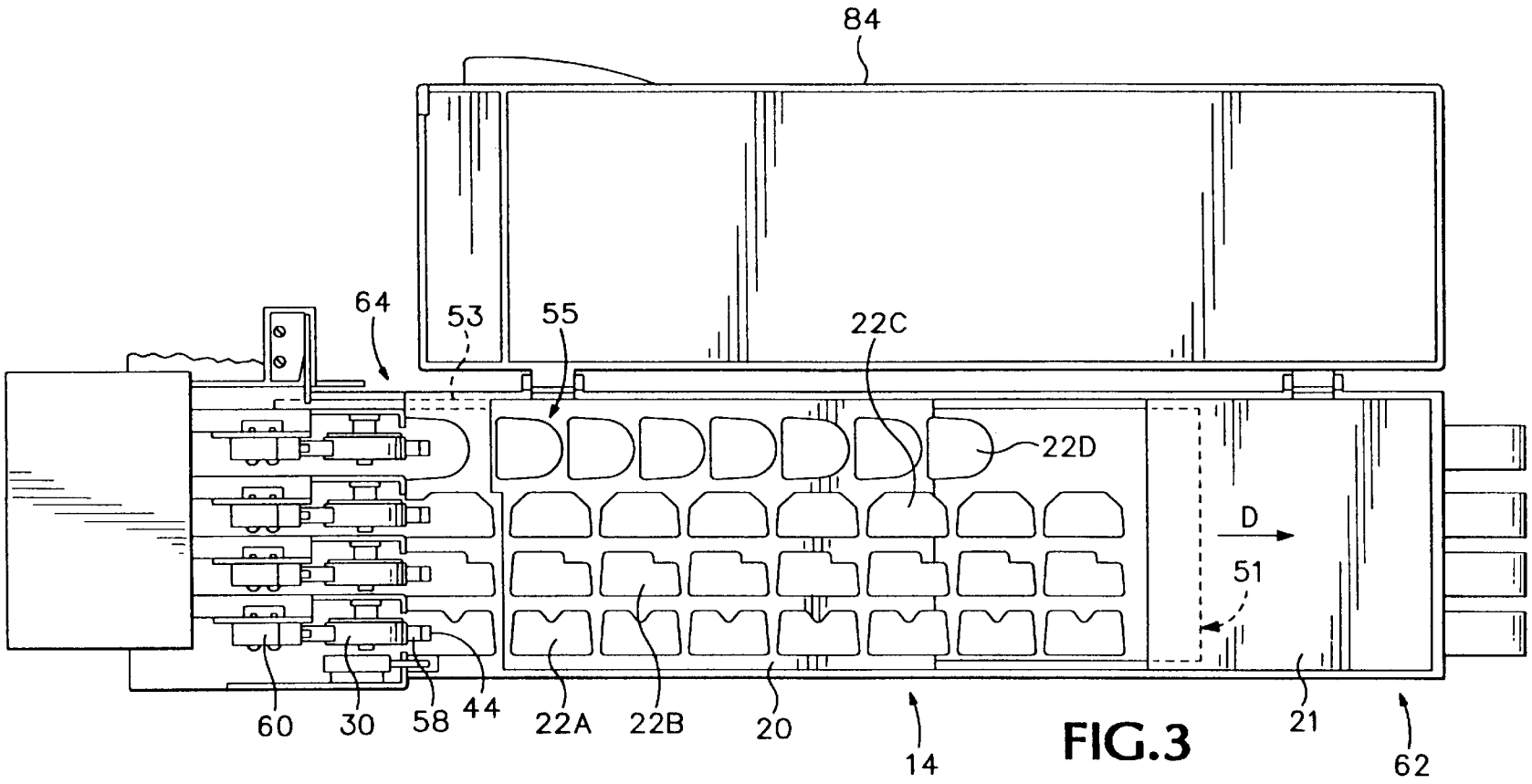
FIG. 3 is a top elevational view taken along the lines 3—3 of FIG. 2 showing a keyed plate positioned in a housing and a cover pivoted open.

With reference now to FIGS. 2 and 3, the ink supply system 12 of the present invention is comprised of a housing, generally represented by the reference numeral 14, that receives and stores solid ink sticks 16 (only one of which is shown in FIG. 2). As illustrated for example in FIG. 3, the preferred embodiment of the housing 14 is generally longer than it is wide, and thus extends along a longitudinal axis. The housing receives a keyed plate 20 that includes a plurality of bottomless receptacles 22A–D. Each of the bottomless receptacles 22A–D corresponds in shape to a distinctive ink stick shape. The commonly-shaped bottomless receptacles 22A–D are arranged in rows with each row positioned above a separate supply channel. FIG. 2 shows a side view in partial cross section of the row of bottomless receptacles 22A and a supply channel 24 below. It will be understood that the other rows of bottomless receptacles 22B–D and the supply channels and related components associated therewith are structurally and functionally equivalent to the bottomless receptacle row 22A, supply channel 24 and related components now described. Accordingly, the following descriptions are applicable to these other rows and associated supply channels and components as well.

Ink Stick Loading

Figure 4:
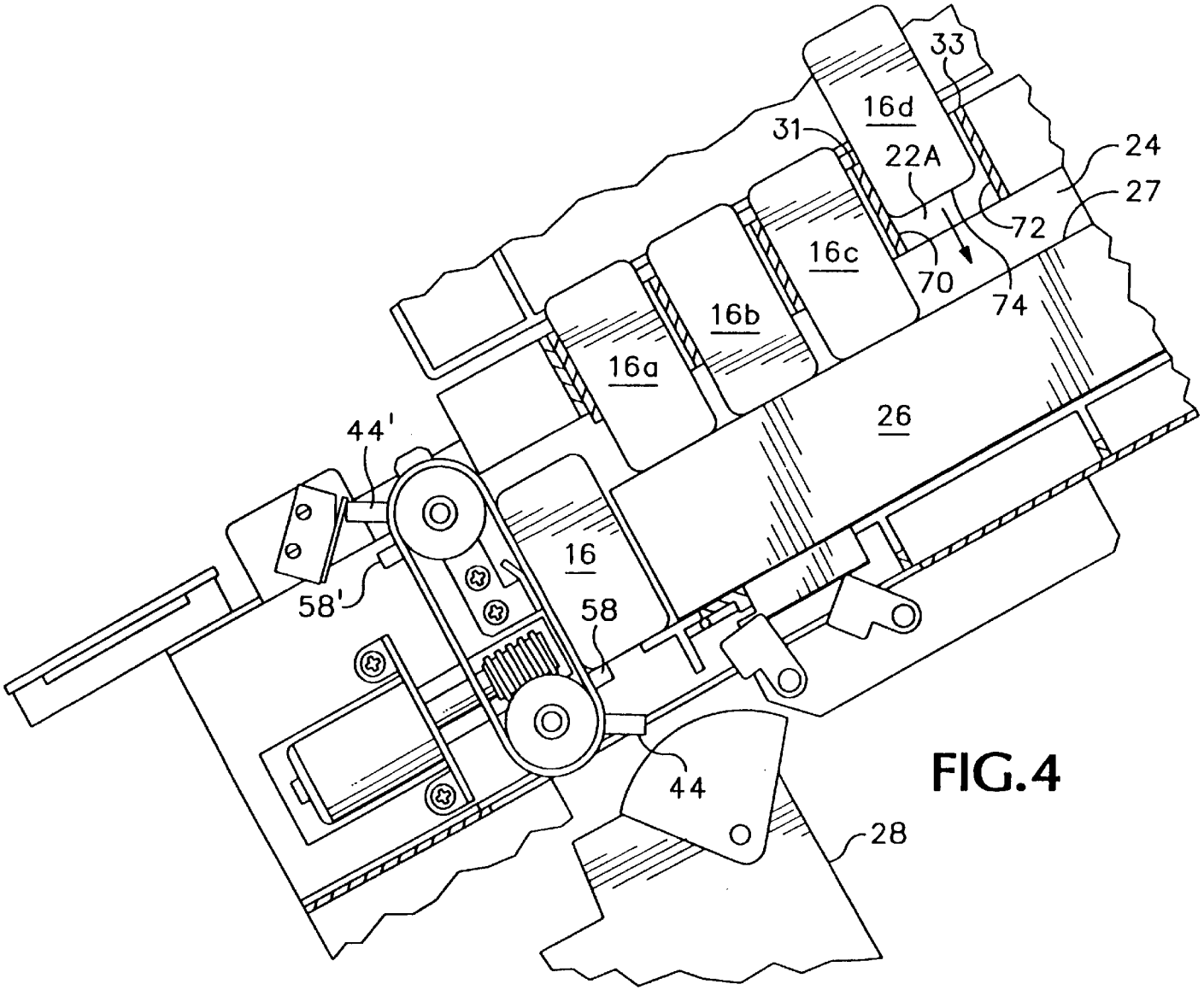
FIG. 4 is a side elevational view in partial cross section showing an ink stick being inserted into a bottomless receptacle in the keyed plate.
Figure 5:
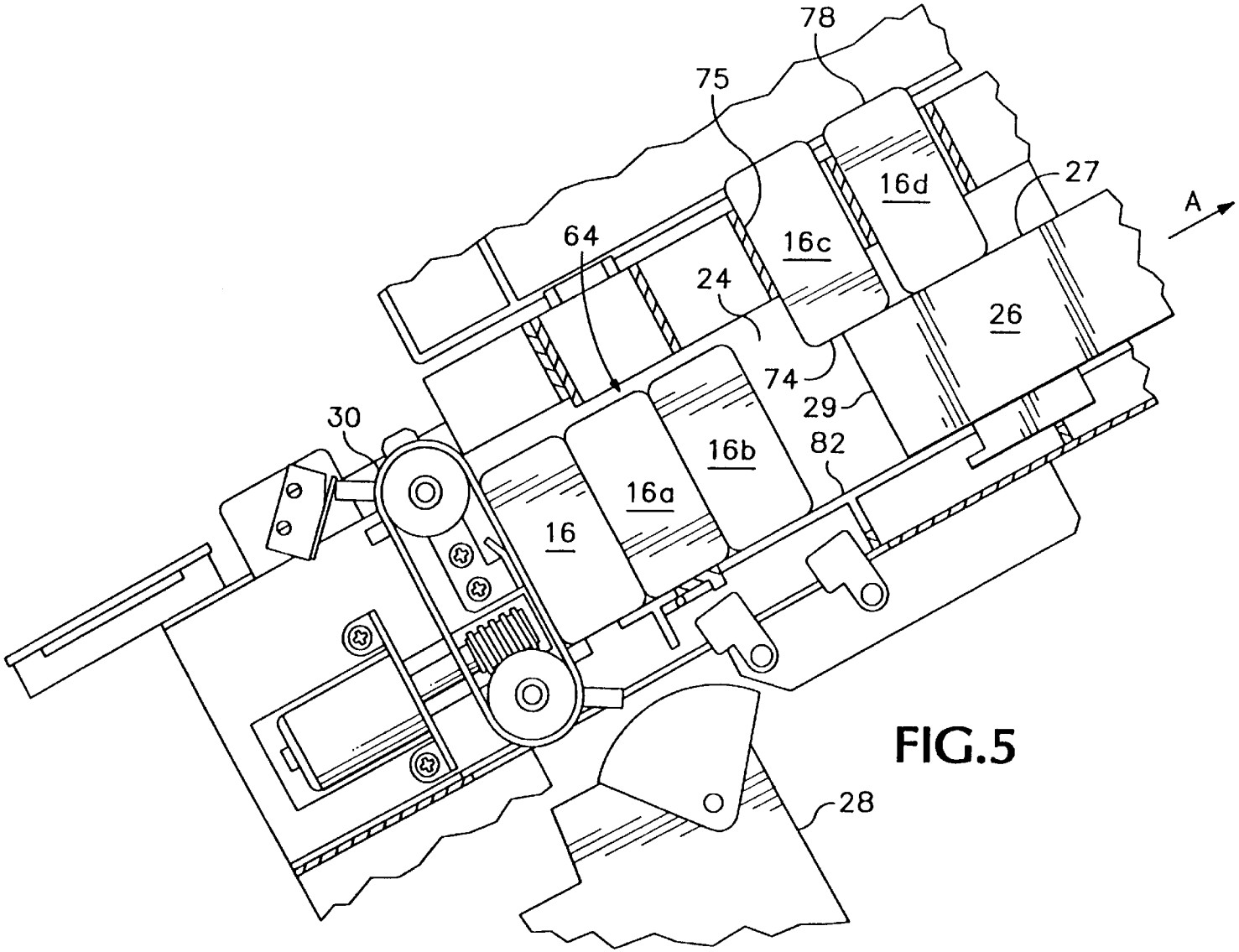
FIG. 5 is a side elevational view in partial cross section showing a pusher rod being retracted in a supply channel during a loading procedure.

With reference now to FIGS. 4 and 5, the solid ink stick supply system of the present invention includes a simple and efficient method for loading multiple ink sticks to refill the system. FIG. 4 shows an ink stick 16*d* being inserted into a bottomless receptacle 22A. As this Figure illustrates, each of the bottomless receptacles 22A defines a bottomless receptacle for receipt of an ink stick. Opposing side walls 70, 72 in the bottomless receptacle 22A guide the ink stick 16*d* as it travels downwardly toward the supply channel 24 below. Ink sticks 16*a–c* have been previously inserted and are being supported by a contacting means in the supply channel 24. In the preferred embodiment of the present invention, the contacting means comprises a pusher rod 26 that slides on a bottom surface 82 of the supply channel 24. As best illustrated in FIG. 2, the housing 14 is inclined elevationally upwardly so that a base end 62 of the supply channel 24 is elevationally higher than a delivery end 64 of the channel, whereby the pusher rod 26 tends to slide downwardly toward the delivery end 64 of the channel.

Referring again to FIGS. 4 and 5, as the ink stick 16*d* continues to move downwardly into the supply channel 24, a bottommost portion 74 of the ink stick 16*d* (FIG. 4) contacts an upper surface 27 of the pusher rod 26 (FIG. 5), while a peripheral portion 75 of the ink stick engages at least one of the opposing side walls 70, 72 of the bottomless receptacle 22A. The ink stick 16*d* is now held in a "ready position" as shown in FIG. 5. Preferably, in this "ready position" a top portion 78 of the ink stick 16*d* protrudes from the bottomless receptacle 22A. Advantageously, this prevents an operator from inserting a second ink stick into that bottomless receptacle and potentially causing a jam or misfeed.

As illustrated in FIG. 5, when a desired number of ink sticks have been inserted into the bottomless receptacles, the pusher rod 26 is retracted in the direction of action arrow A. Preferably, this is accomplished by an operator grasping and pulling the pusher rod handle 80, shown in FIG. 2, away from the housing 14. As a contact surface 29 of the pusher rod 26 passes from beneath each ink stick 16*a–d*, the ink stick is guided by the opposing side walls 70, 72 of the bottomless receptacle 22A to descend in a controlled manner into the supply channel 24. Upon reaching the bottom surface 82 of the supply channel 24, the ink stick moves downwardly toward the delivery end 64 of the channel until it contacts either a previously loaded ink stick, as illustrated by adjacent ink sticks 16*a* and 16*b* in FIG. 5, or the adjacent endless belt, as illustrated by ink stick 16.

Figure 6:
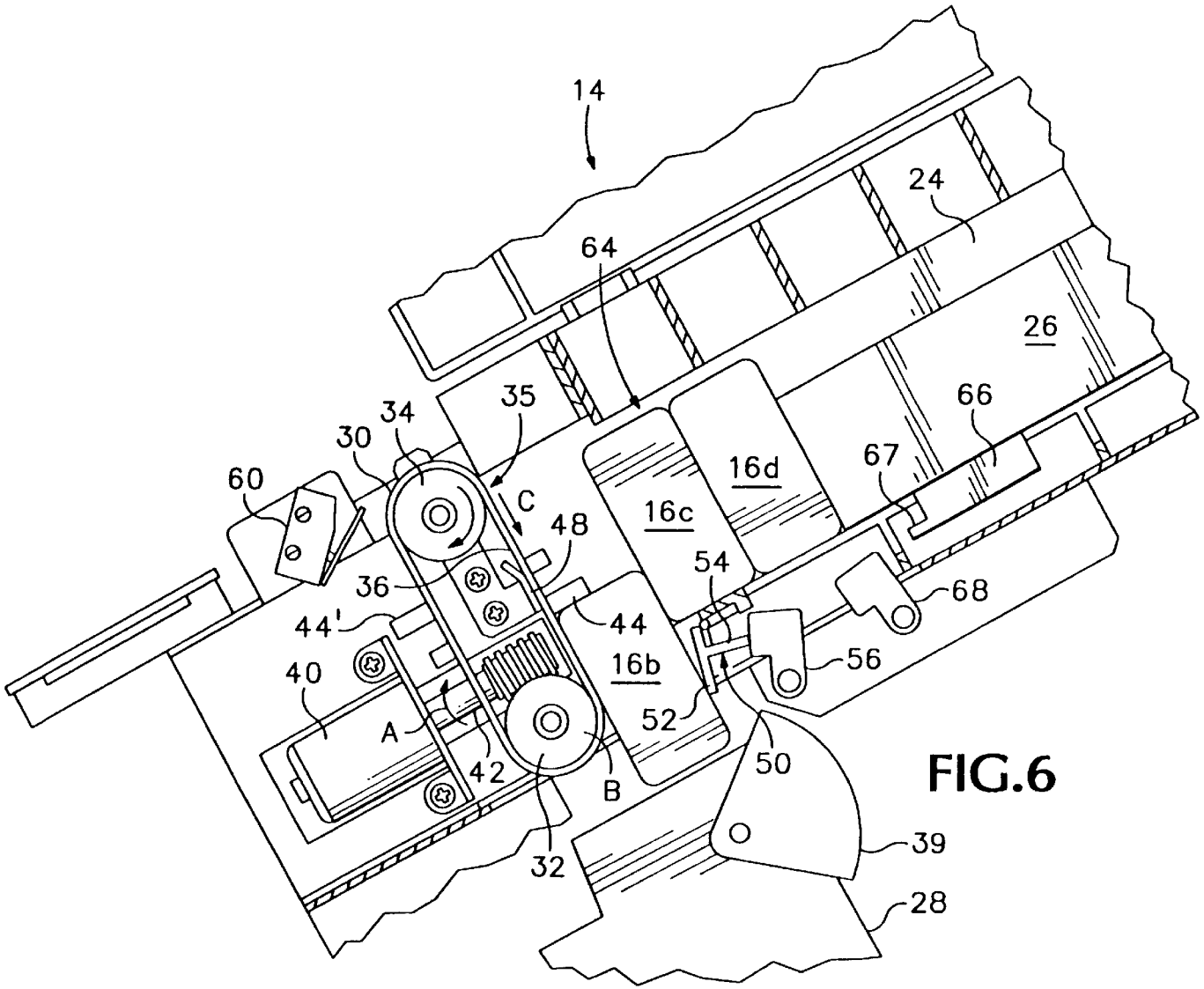
FIG. 6 is a side elevational view in partial cross section showing a first push device on an endless belt engaging an ink stick and delivering the ink stick to a print head reservoir.
Figure 7:
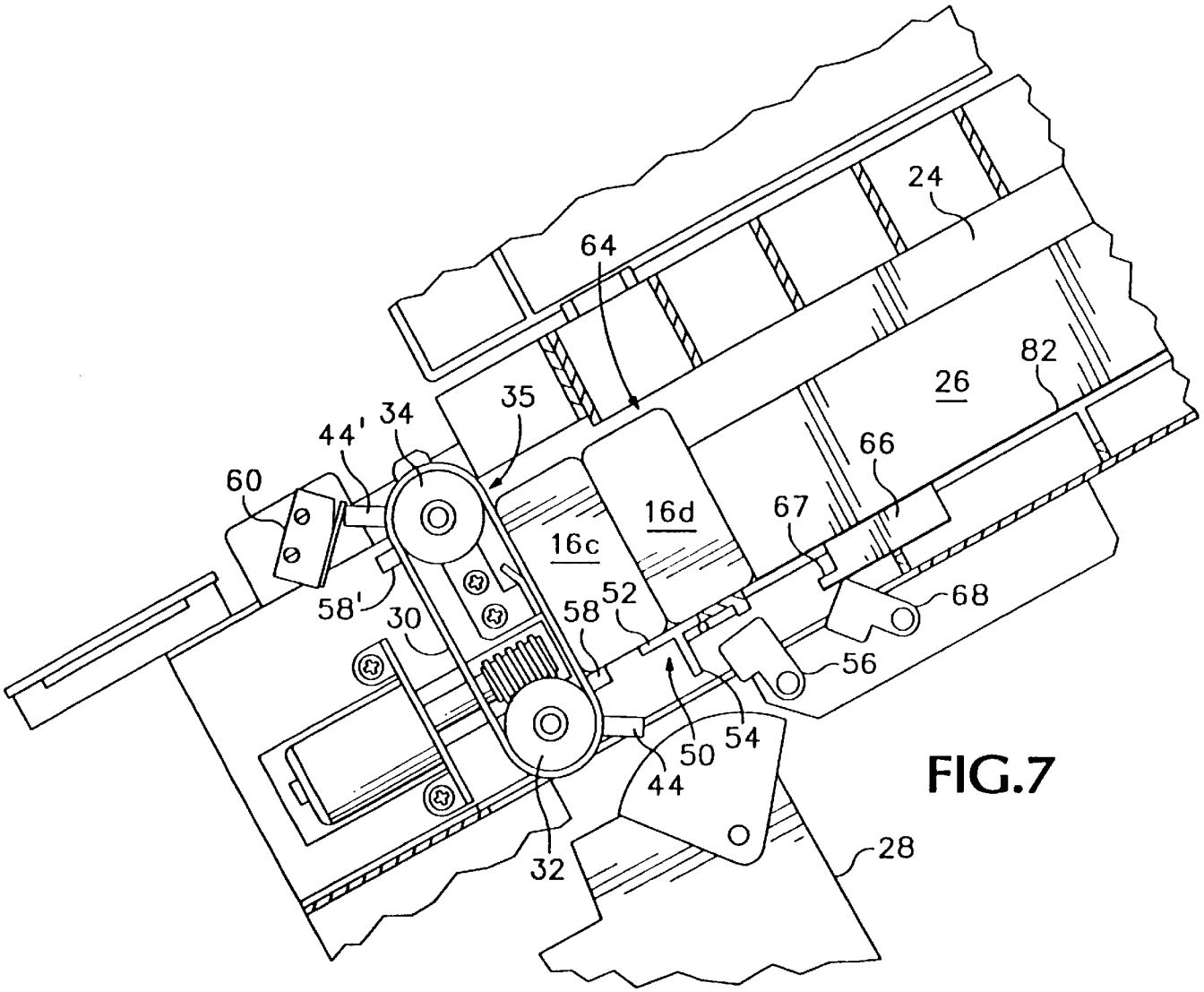
FIG. 7 is a side elevational view in partial cross section showing the endless belt in a stationary, post-delivery position with a first stop device retaining an ink stick on the belt.

After the desired number of ink sticks have been loaded into the supply channel 24, the operator allows the pusher rod 26 to slide downwardly in the channel until the pushing surface 29 on the rod positively engages the rearmost ink stick in the channel, as shown in FIG. 6. With reference now generally to FIGS. 6 and 7, as ink sticks are delivered one-by-one to the print head reservoir 28, the pusher rod 26 positively transfers the ink sticks remaining in the supply channel 24 toward the delivery end 64 of the channel. Advantageously, the lateral force imparted on the remaining ink sticks by the pusher rod 26 prevents the ink sticks from adhering to an adjacent surface in the supply channel 24, and potentially tipping and thereby jamming or interrupting the ink stick supply. Additionally, as the pusher rod 26 advances down the supply channel 24 with the delivery of each ink stick, the rod is automatically positioned under a bottomless receptacle 22A and ready for supplemental ink stick loading.

With reference now only to the preferred embodiment of the present invention, it is important that the ink sticks are properly oriented in each supply channel for transfer to an adjacent endless belt. More specifically, as shown in FIG. 5, the bottommost portion 74 of each ink stick must be substantially flush with the bottom surface 82 of the supply channel 24. Adjacent ink sticks in the supply channel must also be in mated peripheral alignment, as illustrated by ink sticks 16, 16*a* and 16*b* in FIG. 5.

Initially, the required orientation is achieved by aligning the ink sticks with the bottomless receptacles 22A–D in the keyed plate 20 as shown in FIG. 3. With reference now to FIG. 4, to maintain this orientation as an ink stick travels from a bottomless receptacle 22A into a supply channel 24, the opposing side walls 70, 72 of the bottomless receptacle are given a height that is at least 25% of the length of the ink stick. Additionally, the distance between the upper surface 27 of the pusher rod 26 and the upper ends 31, 33 of the side walls 70, 72 is at least 50% of the length of the ink stick. Together, these two provisions insure that an ink stick is guided by the opposing side walls 70, 72 of a bottomless receptacle 22A such that the ink stick maintains its initial orientation and descends in a controlled manner into the supply channel below.

With reference now to FIGS. 6 and 7, the housing 14 includes means for detecting a low ink condition. For the purposes of the following discussion only, a low ink condition is defined as two or less ink sticks available for delivery to the print head reservoir 28. In the preferred embodiment of the present invention, the detecting means comprises a tab 66 that extends downwardly from the pusher rod 26 and through a slot (not shown) in the supply channel 24. As illustrated in FIGS. 6 and 7, upon delivery of the ink stick 16*b* to the print head reservoir 28, the pusher rod 26 advances downwardly in the supply channel 24 such that a protruding tongue 67 on tab 66 engages and pivots a low ink trip lever 68. The low ink trip lever 68 operates in conjunction with an optical sensor (not shown) to signal the low ink condition by illuminating an indicator light on a status panel 11 on the printer 10, as shown in FIG. 1. When the pusher rod 26 is retracted upon loading additional ink sticks into the supply channel 24, the low ink trip lever 68 returns by spring biasing (not shown) to its initial position shown in FIG. 6.

Figure 3A:
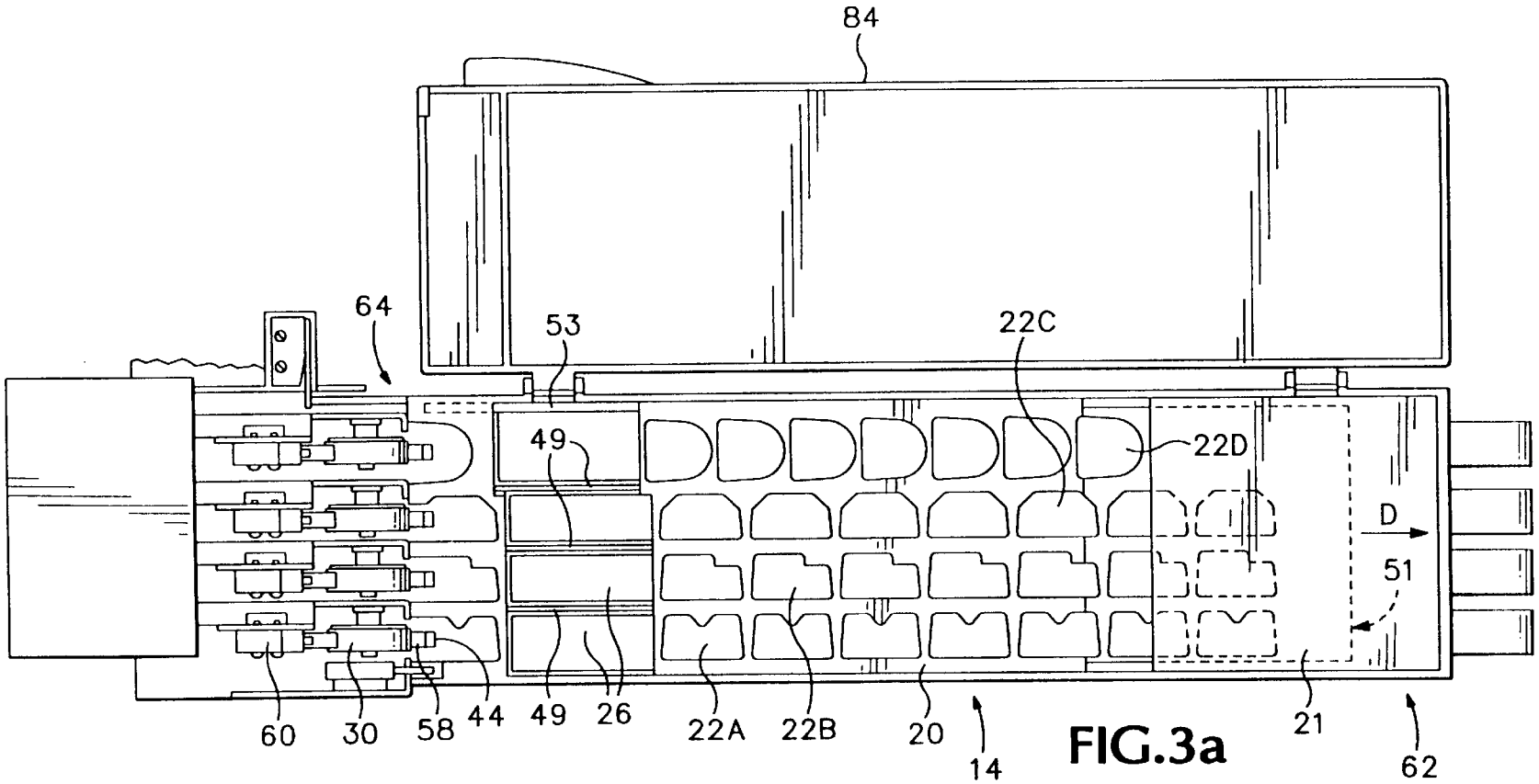
FIG. 3*a* is a top elevational view taken along the lines 3—3 of FIG. 2 showing the keyed plate sliding toward a base end of the housing to expose the pusher rods in the supply channels below.

With reference now to FIGS. 3 and 3*a*, the preferred embodiment of the present invention also includes a pivotable cover plate 84 to enclose the keyed plate 20 and the supply channels 24 when the loading of ink sticks is completed. Additionally, as indicated by action arrow D in FIGS. 3 and 3*a*, the keyed plate 20 is preferably slidable within the housing 14 along the longitudinal axis of the housing. As best seen in FIG. 3*a*, the keyed plate 20 rests atop and slides on the supply channel dividers 49 that separate adjacent pusher rods 26 in the supply channels 24 (see also FIG. 2). Advantageously, this sliding feature of the keyed plate 20 allows an operator to gain access to the supply channels 24 below to clear any ink stick jams or misfeeds.

As explained above, it is important that the ink sticks are properly oriented in each supply channel 24 for transfer to the adjacent endless belt. Loading the ink sticks through the keyed plate 20 automatically provides this proper orientation. Thus, while it is desirable that the keyed plate 20 is moveable to allow access to the supply channels 24, it is also desirable to insure that the keyed plate is not removed from the housing 14 so that it is always used to load the ink sticks. Accordingly, the present invention includes means for retaining the keyed plate 20 within the housing 14 while still allowing the keyed plate to slide relative to the housing to expose the pusher rods 26 and supply channels 24 below. In the preferred embodiment, the means for retaining comprises a retention plate 21 that is positioned at a base end 62 of the housing 14.

As shown in FIGS. 2, 3 and 3*a*, the retention plate 21 extends over a rear portion 51 of the keyed plate to prevent the rear portion from being lifted out of the housing 14. As illustrated in FIG. 3*a*, the keyed plate 20 slides under the retention plate 21 to give access to the supply channels 24 below. Additionally, the keyed plate 20 includes a tab 53 that extends from a front portion 55 of the keyed plate and into a mating aperture within the housing 14. Advantageously, the tab 53 prevents the front portion 55 the keyed plate 20 from being lifted upwardly. It will be appreciated that other means for retaining may also be utilized, such as a grooved slot in a side wall of the housing 14 and a corresponding projection extending from the keyed plate 20 that slides within the slot.

With reference now to FIG. 2, the present invention also includes a biaser for biasing the keyed plate 20 toward the delivery end 64 of the housing 14 to maintain the keyed plate 20 in its normal operating position. Preferably, the biaser comprises a coil spring 23 that has one end 25 in contact with a rear face 37 of the keyed plate 20 and the opposite end 41 in contact with a base flange 43. To insure that the coil spring 23 compresses and expands substantially linearly, a guide rod 47 extends a fixed distance from the base flange 43 within the coil spring.

Ink Stick Delivery

Figure 9:
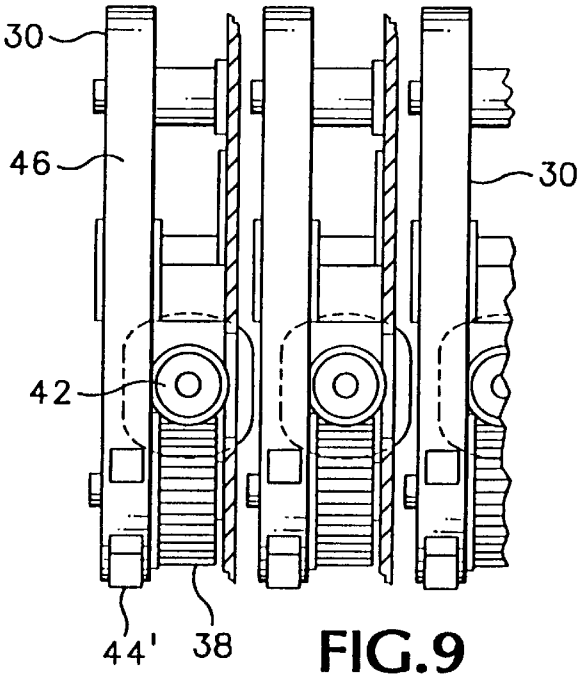
FIG. 9 is an enlarged partial top view taken along the lines 9—9 of FIG. 8 showing side-by-side endless belts, each belt being adjacent to a gear that is driven by a worm.

The present invention utilizes conveyer means and means for driving the conveyor means to deliver color solid ink sticks to a corresponding ink jet print head reservoir of the same color. As shown in FIGS. 3, 6 and 9, the preferred conveyor means comprises a plurality of endless belts 30, with each endless belt being adjacent to one of the supply channels 24, as best seen in FIG. 6. For each endless belt 30, the driving means preferably includes a drive pulley 32 and a driven pulley 34 that engage the inner surface 36 of the belt 30. To insure accurate movement of the belt without slippage, the inner surface 36 of the endless belt 30 is given a toothed profile (not shown) that mates with the periphery of the drive and driven pulleys 32, 34. With reference to FIG. 9, a gear 38 is adjacent to the drive pulley 32 and shares a common axis of rotation with the drive pulley. The gear 38 is driven by a power source to rotate the drive pulley 32, which in turn advances the endless belt 30. Preferably, the power source comprises a 12 volt DC motor 40 and a worm 42 that engages the gear 38 as shown.

Figure 8:
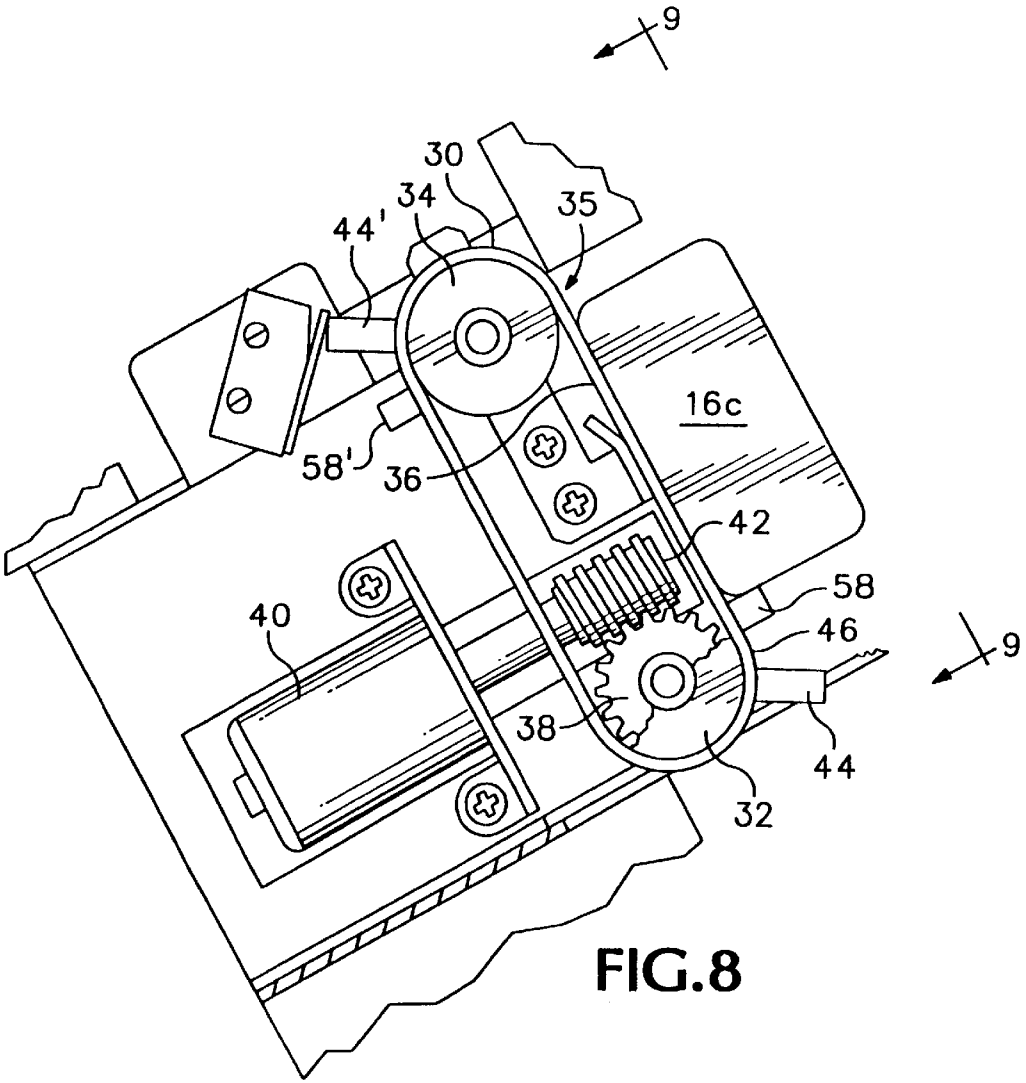
FIG. 8 is an enlarged side view in partial cross section of the endless belt showing a drive and a driven pulley engaging the endless belt and a worm engaging a gear.

In an important aspect of the present invention, the endless belt 30 includes a first push device 44 that positively engages and delivers an individual ink stick to the print head reservoir 28. As shown in FIG. 8, the first push device 44 extends from the outer surface 46 of the belt 30. With reference now to FIG. 6, during a delivery sequence the print head reservoir 28 is moved to a loading position adjacent to one end of the endless belt 30 and the protective cover 39 of the reservoir is pivoted open by a rack and pinion actuator (not shown). The motor 40 is activated to rotate the worm 42 in the direction of action arrow A. The worm 42 rotates the gear 38 (not shown), which by a common axis rotates the drive pulley 32 in the direction of action arrow B. An ink side track 35 of the endless belt 30 is then advanced in the direction of action arrow C such that the first push device 44 engages the ink stick 16*b* and positively moves the ink stick into the reservoir 28.

As shown in FIG. 6, prior to and during the delivery sequence the ink stick 16*b* is in contact with an adjacent ink stick 16*c* in the supply channel 24. Over time, and in the heat of the printing environment, the two ink sticks 16*b*, 16*c* may adhere to one another along their common surface. Any such adherence will oppose the movement of ink stick 16*b* into the reservoir 28, and potentially could cause a jam or misfeed at the endless belt 30. Advantageously, the first push device 44 substantially avoids this potential problem by affirmatively separating the two ink sticks 16*b*, 16*c* and positively pushing ink stick 16*b* until it leaves the endless belt 30 and enters the reservoir 28.

With continued reference to FIG. 6, the weight of ink sticks 16*b–d* and pusher rod 26 tends to deflect the ink side track 35 of the endless belt 30 inwardly and increase the load on the drive and driven pulleys 32, 34. Additionally, as explained above, any adherence between adjacent ink sticks 16*b*, 16*c* will oppose the movement of ink stick 16*b*. As the first push device 44 engages the ink stick 16*b*, this adherence creates a bending force at the point of attachment of the push device 44 to the endless belt 30. To support the ink side track 35 of the belt 30 between the drive and driven pulleys 32, 34, a flange 48 is provided adjacent to the inner surface 36 of the ink side track 35 at the location where the ink sticks contact the belt 30. Advantageously, the flange 48 prevents the belt 30 from deflecting excessively and counteracts the bending force on push device 44 during the delivery of an ink stick.

With reference now to FIG. 7, the endless belt 30 further includes a first stop device 58 that retains an ink stick on the endless belt 30 prior to its delivery to the print head reservoir 28. The first stop device 58 is spaced from the first push device 44 such that at the end of a delivery sequence the stop device is positioned substantially parallel with the bottom surface 82 of the supply channel 24, as illustrated in FIG. 7. In this manner, after the ink stick 16*b* is delivered to the print head reservoir 28, the next ink stick 16*c* is transferred from the supply channel 24 to the endless belt 30 and is retained by the first stop device 58 from entering the print head reservoir 28.

With continued reference to FIG. 7, in the preferred embodiment a second push device 44' and a second stop device 58' are provided on the endless belt 30. Preferably, the second push and stop devices 44', 58' are substantially equidistant from the first push and stop devices 44, 58, respectively, along the circumference of the belt 30. Upon delivery of the ink stick 16*b* (not shown) to the print head reservoir 28 by the first push device 44, the second push device 44' engages a contact 60 to stop the motor 40 and halt the advancement of the endless belt 30. In the next delivery sequence, the motor 40 will be activated by the printer firmware (not shown) to advance the endless belt 30, whereby the push device 44' will contact and deliver ink stick 16*c* to the reservoir 28 and push device 44 will engage the contact 60 at the completion of the delivery.

Figure 10:
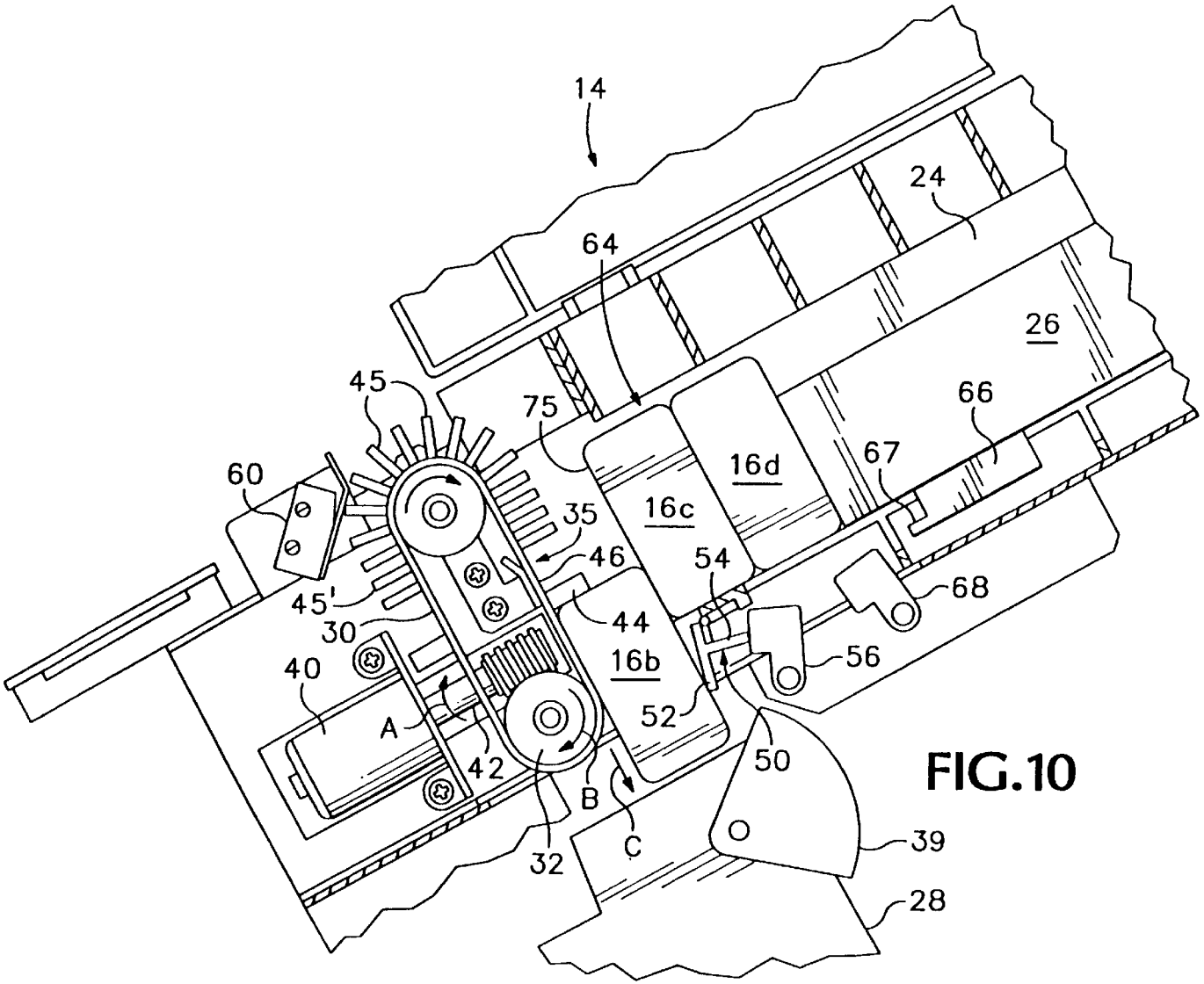
FIG. 10 is a side elevational view in partial cross section of an alternative embodiment of the present invention showing a first push device on an endless belt engaging an ink stick and a plurality of tabs extending from the belt.
Figure 11:
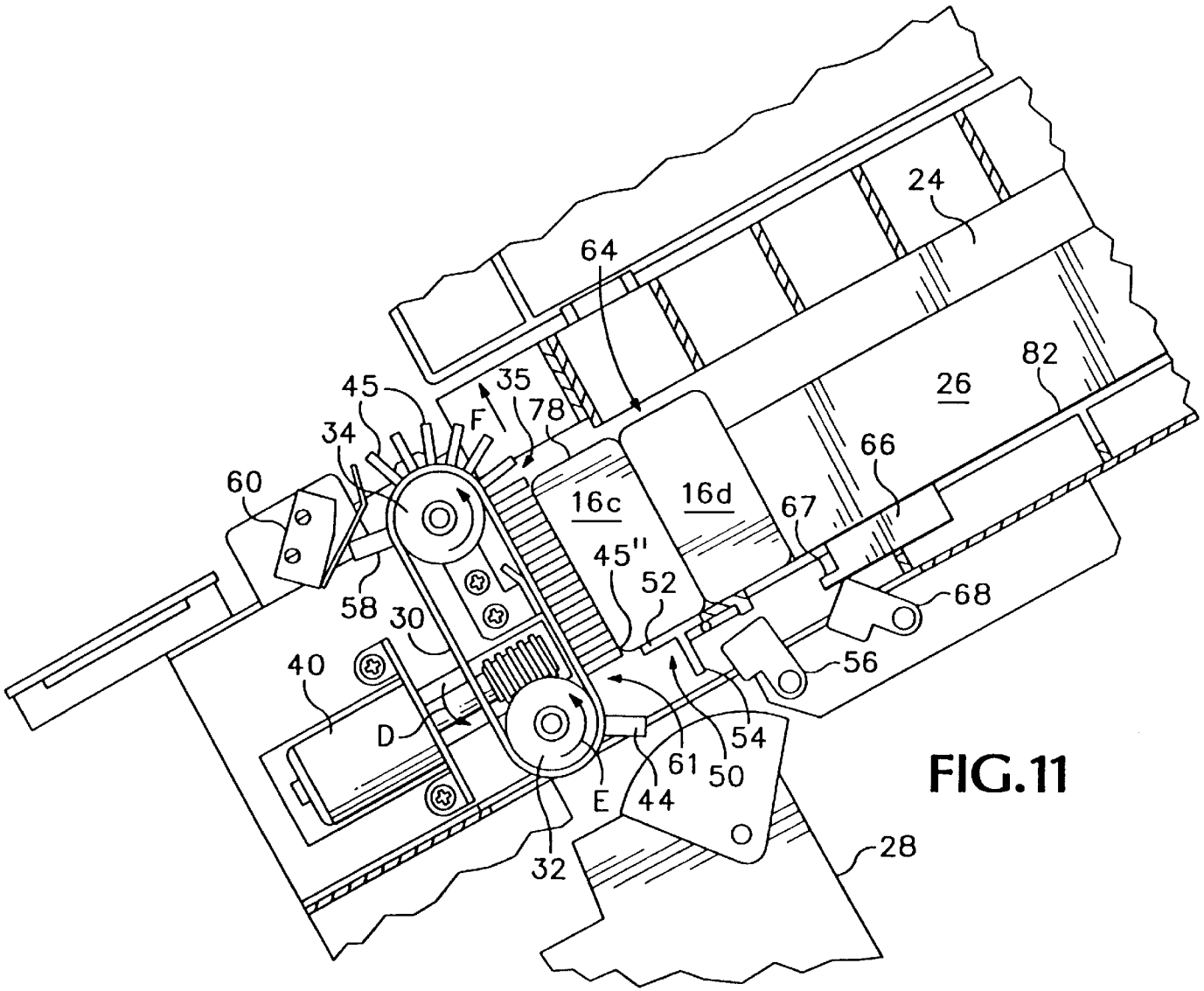
FIG. 11 is a side elevational view in partial cross section of the alternative embodiment showing the endless belt advancing in a second direction and the tabs on the endless belt supporting an ink stick.

With reference now to FIGS. 10 and 11, an alternative embodiment of the present invention includes support means for supporting a second ink stick 16*c* above the ink side track 35 of the endless belt 30 while a first ink stick 16*b* is delivered to the print head reservoir 28. Preferably, the support means comprises a plurality of tabs 45 extending from the outer surface 46 of the belt 30. As shown in FIG. 10, during a delivery sequence the motor 40 is activated to rotate the worm 42 in the direction of action arrow A. The worm 42 rotates the gear 38 (not shown), which by a common axis rotates the drive pulley 32 in the direction of action arrow B. The ink side track 35 of the endless belt 30 is then advanced in a first direction, as indicated by action arrow C, such that the first push device 44 engages the ink stick 16*b* and positively moves the ink stick into the reservoir 28, while the tabs 45 move adjacent to the periphery 75 of the ink stick 16*c*. The tabs 45 also engage and close the contact 60, which in turn signals the printer firmware (not shown) that a delivery sequence is in progress.

With reference now to FIG. 11, as ink stick 16*b* (not shown) moves into the print head reservoir 28, ink stick 16*c* is transferred against the tabs 45 and is thereby spaced from the ink side track 35 of the belt 30. After the rearmost tab 45' passes the contact 60, the contact 60 opens to signal the printer firmware that the delivery of ink stick 16*b* to the reservoir 28 is completed. At this point, the printer firmware stops the motor 40 and then reverses the motor to rotate the worm 42 in the direction of action arrow D. Drive pulley 32 rotates in the direction of action arrow E which in turn advances the ink side track 35 of the endless belt 30 in a second direction indicated by action arrow F. As the belt 30 advances in this manner, the tabs 45 will slide along the periphery 75 of the ink stick 16*c* and will close contact 60. Once the first push device 44 passes the top portion 78 of the ink stick 16*c*, the ink stick 16*c* is fully transferred to the endless belt 30. Shortly thereafter, contact 60 opens within the gap 61 between the first push device 44 and the frontmost tab 45" to halt the advancement of the belt 30, and the ink stick 16*c* is retained on the belt by the first stop device 58 in the same manner as shown in FIG. 7.

Advantageously, during the delivery of ink stick 16*b* to the reservoir 28, ink stick 16*c* is supported above and away from the ink side track 35 of the belt 30 to reduce the possibility of an ink stick jam. Additionally, as the tabs 45 slide along the periphery 75 of the ink stick 16*c*, the tabs agitate and vibrate both ink sticks 16*c* and 16*d* in the supply channel 24. In this manner, the tabs 45 loosen any adherence between the two ink sticks 16*c* and 16*d*, as well as any adherence between the ink sticks and an adjacent surface of the supply channel 24, to facilitate a smooth transfer to the endless belt 30.

With reference now to FIG. 6, a means for confirming the delivery of an ink stick to the print head reservoir 28 is also provided. In the preferred embodiment, the confirming means comprises a gate, generally represented by the reference numeral 50, and a delivery trip lever 56. As best seen in FIG. 7, the gate 50 is biased in a position such that a first arm 52 extends into the path of the ink stick 16*c* to the print head reservoir 28. With reference now to FIG. 6, during a delivery sequence the ink stick 16*b* pushes against the first arm 52 to pivot the gate 50 such that a second arm 54 contacts and pivots the delivery trip lever 56. The delivery trip lever 56 operates in conjunction with an optical sensor (not shown) to confirm the delivery of the ink stick 16*b* to the print head reservoir 28. After the ink stick 16*b* has been delivered, the gate 50 returns to its initial position as shown in FIG. 7 by spring biasing (not shown). As it will be appreciated, the first arm 52 of the gate 50 also guides an ink stick as it is transferred from the supply channel 24 onto the endless belt 30. In this manner, the gate 50 prevents the ink stick from tipping or misfeeding and possibly causing a jam. The gate 50 also assists the stop devices 58, 58' in preventing a second ink stick from entering the reservoir 28 after the delivery of a first ink stick.

While the invention has been described above with reference to specific embodiments thereof, it is apparent that many changes, modifications and variations in the materials, arrangements of parts and steps can be made without departing from the inventive concepts disclosed herein. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

Having thus described the invention, what is claimed is:

1. A solid ink supply system for feeding solid ink sticks to an ink print head reservoir, comprising:

a housing for receiving and storing the solid ink sticks, the housing having a longitudinal axis;

at least one supply channel within the housing;

conveyor means adjacent to a delivery end of the housing;

contacting means in the supply channel for transferring the solid ink sticks from the supply channel to the conveyor means;

means for driving the conveyor means;

a keyed plate slidably but not removably received within the housing and positioned adjacent to the supply channel, the keyed plate including at least one bottomless receptacle for receiving at least one of the solid ink sticks; and means for retaining the keyed plate within the housings while allowing the keyed plate to slide relative to the housing to allow access to the supply channel.

2. The solid ink supply system of claim 1, wherein the keyed plate is slidable in a direction parallel to the longitudinal axis of the housing.

3. The solid ink supply system of claim 2, wherein the means for retaining comprises a retention plate positioned at a base end of the housing, the retention plate extending over at least a portion of the keyed plate such that the keyed plate may slide beneath the retention plate but may not be removed from the housing.

4. The solid ink supply system of claim 3, wherein the means for retaining further comprises a tab extending from a front portion of the keyed plate into a mating aperture within the housing.

5. The solid ink supply system of claim 4, wherein the bottomless receptacle in the keyed plate is in communication with the supply channel.

6. The solid ink supply system of claim 5, wherein the bottomless receptacle in the keyed plate includes opposing side walls configured adapted to guide the one of the solid ink sticks into the supply channel.

7. The solid ink supply system of claim 6, wherein each of the solid ink sticks has a predetermined length and the opposing side walls of the bottomless receptacle have a height that is at least 25% of the length of the ink sticks.

8. The solid ink supply system of claim 7, wherein the opposing side walls of the bottomless receptacle include an upper end and a distance between an upper surface of the contacting means in the supply channel and the upper end of the bottomless receptacle is at least 50% of the length of the ink sticks.

9. The solid ink supply system of claim 8, wherein the bottomless receptacle corresponds in shape to a solid ink stick having a similar shape.

10. The solid ink supply system of claim 9, wherein the keyed plate includes a plurality of bottomless receptacles for receiving the solid ink sticks, the solid ink sticks having a plurality of distinctive shapes, and each of the bottomless receptacles having a shape that corresponds to one of the plurality of distinctive ink stick shapes.

11. The solid ink supply system of claim 10, wherein each of the plurality of bottomless receptacles having a similar shape has a similar orientation.

12. The solid ink supply system of claim 11, wherein the housing includes a pivotable cover configured to enclose the keyed plate and supply channel.

* * * * *